United States Patent [19]

Centa

[11] Patent Number: 4,637,752

[45] Date of Patent: Jan. 20, 1987

[54] ACCESS COVERS FOR MANHOLES

[76] Inventor: Antony R. Centa, Howe Green Lane, Little Berkhamsted, Hertford, Hertfordshire, England, 3G13 8LH

[21] Appl. No.: 726,898

[22] PCT Filed: Aug. 13, 1984

[86] PCT No.: PCT/GB84/00280

§ 371 Date: Apr. 17, 1985

§ 102(e) Date: Apr. 17, 1985

[87] PCT Pub. No.: WO85/00843

PCT Pub. Date: Feb. 28, 1985

[30] Foreign Application Priority Data

Aug. 18, 1983 [GB] United Kingdom ..... 8322225

[51] Int. Cl.[4] ..... E02D 29/14

[52] U.S. Cl. ..... 404/25; 52/19

[58] Field of Search ..... 404/25, 26, 135, 136; 52/19, 20, 21, 601, 656, 677, 684, 688, 689; 49/504; 160/381; 403/295, 401, 402, 403

[56] References Cited

U.S. PATENT DOCUMENTS

| | | | |
|---|---|---|---|
| 2,101,349 | 12/1937 | Sharp | 403/295 X |
| 2,877,696 | 3/1959 | Elkington | 404/25 |
| 3,797,194 | 3/1974 | Ekstein | 52/656 X |
| 3,975,870 | 8/1976 | Naka | 404/25 X |
| 4,443,973 | 4/1984 | Naka | 52/20 X |
| 4,498,804 | 2/1985 | Ferns | 404/25 |

FOREIGN PATENT DOCUMENTS

| | | | |
|---|---|---|---|
| 463984 | 7/1975 | Australia . | |
| 142160 | 5/1985 | European Pat. Off. | 52/20 |
| 532509 | 8/1931 | Fed. Rep. of Germany . | |
| 2151698 | 4/1973 | France . | |
| 2456169 | 12/1980 | France . | |
| 606014 | 9/1948 | United Kingdom . | |
| 902650 | 8/1962 | United Kingdom . | |
| 1077323 | 7/1967 | United Kingdom | 52/684 |
| 1102946 | 2/1968 | United Kingdom . | |
| 1360790 | 7/1974 | United Kingdom . | |
| 2092649 | 7/1984 | United Kingdom . | |

*Primary Examiner*—James A. Leppink
*Assistant Examiner*—Matthew Smith
*Attorney, Agent, or Firm*—Hayes, Davis & Soloway

[57] ABSTRACT

A manhole access cover comprises a removable cover member which fits within an outer frame, the cover member comprising an inner frame with an appropriate filling (44). Each of the inner and outer frames are fabricated from a plurality of lengths of angle-sectioned members (1, 21) mitred at their ends and joined to each other at the corners of the frame so that the frame comprises a substantially vertical wall formed from vertical (3, 33) limbs of the frame members and a substantially horizontal ledge extending inwardly from the vertical wall and formed from horizontal limbs (2, 22) of the frame members. The joint at each corner includes an angular corner member (9) extending around the corner on the vertical wall and to which the angle-sectioned members are crimped by piercing metal out of the angle-sectioned members (15) and crimping it into the corner members. The joint at each corner also includes an angular corner plate (8) which extends across the mitre between the horizontal limbs of the frame members towards their free edge.

4 Claims, 11 Drawing Figures

ACCESS COVERS FOR MANHOLES

This invention relates to manhole access covers of the kind in which a removable cover member fits within an outer frame, the cover member itself being fabricated as a frame (hereinafter referred to as the inner frame) which is filled with concrete or other appropriate material.

The object of the invention is to provide an access cover whose outer and inner frames can be produced econcmically.

According to the invention, an access cover has outer and inner frames each of which is fabricated from a plurality of angle members joined to each other at the corners of the frame, the joint at each corner including a corner member extending around the corner and to which the angle members at each corner are crimped by piercing metal out of the angle members and crimping it into the corner members.

Other advantageous features of the invention will become apparent from the ensuing description of one construction of manhole access cover in accordance with the invention and shown in the accompanying drawings.

Figure 1:
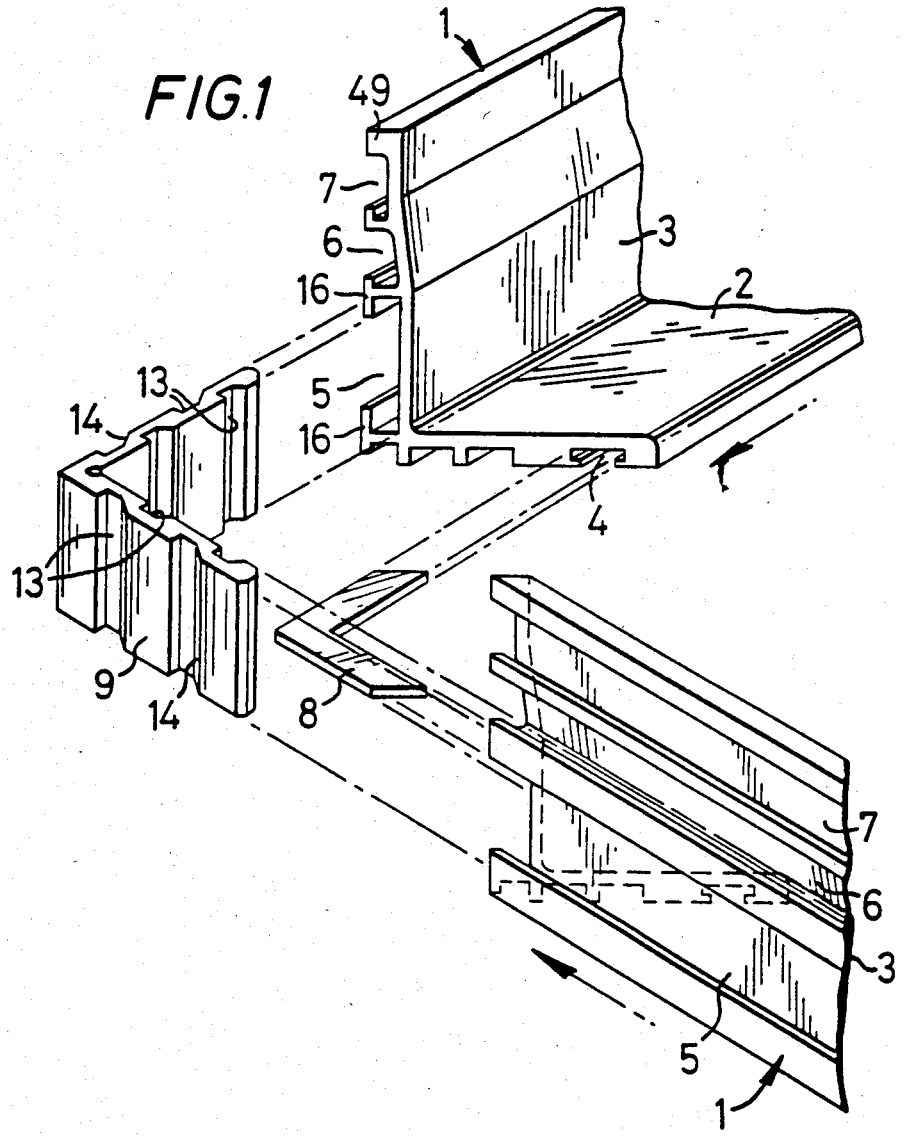
Figure 2:
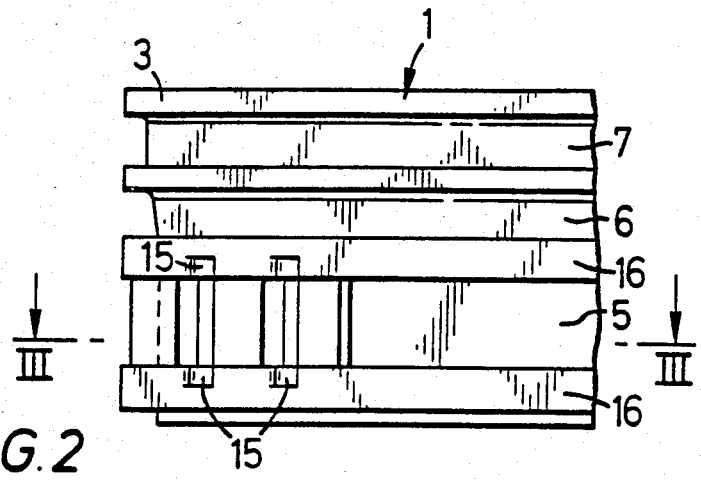

Fig. 1 is an exploded perspective view showing the manner of assembly of the outer frame at the corners of the frame, FIG. 2 shows a side elevation of an assembled corner of the outer frame.

Figure 3:
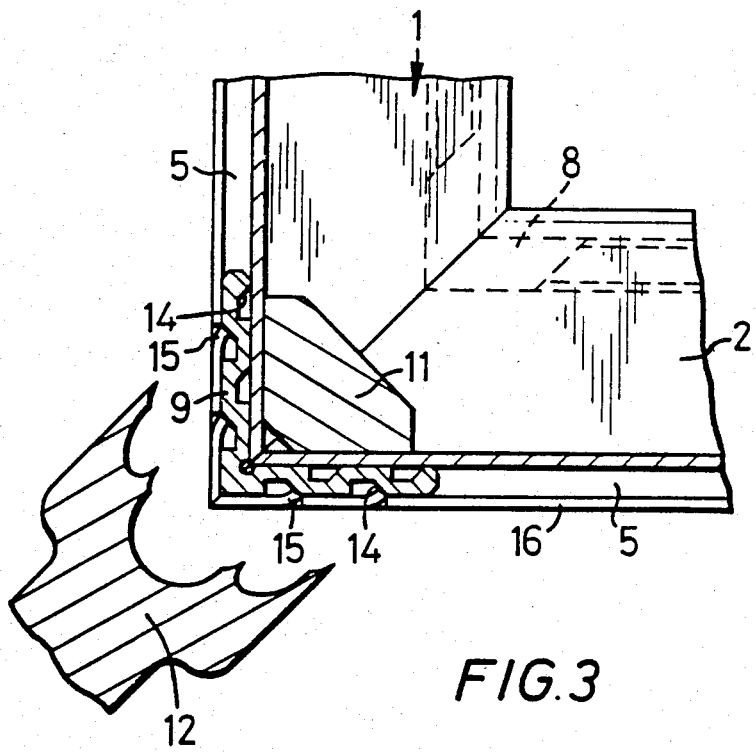
Figure 4:
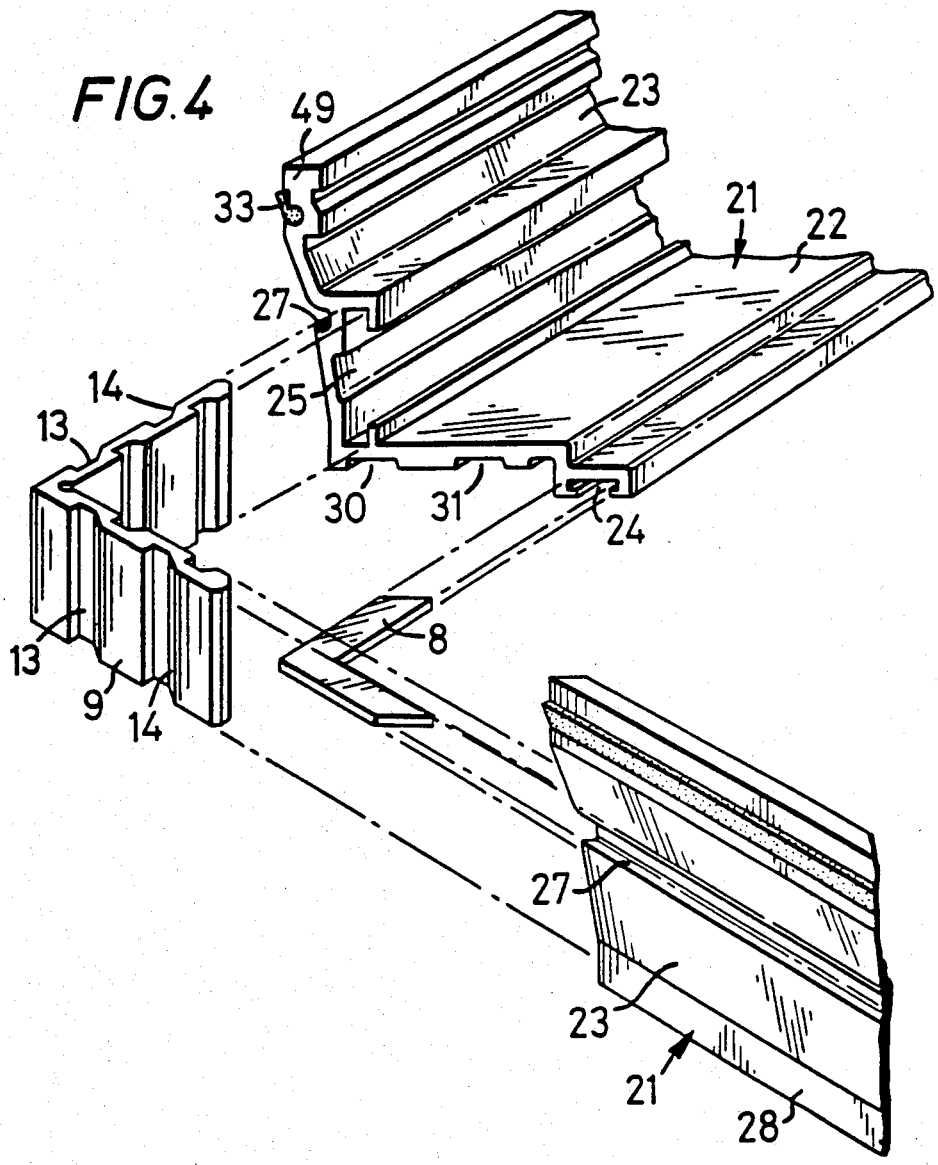
Figure 5:
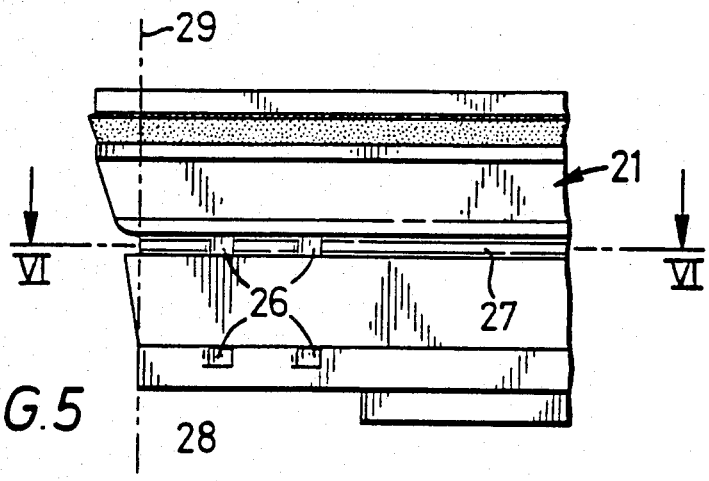
Figure 6:
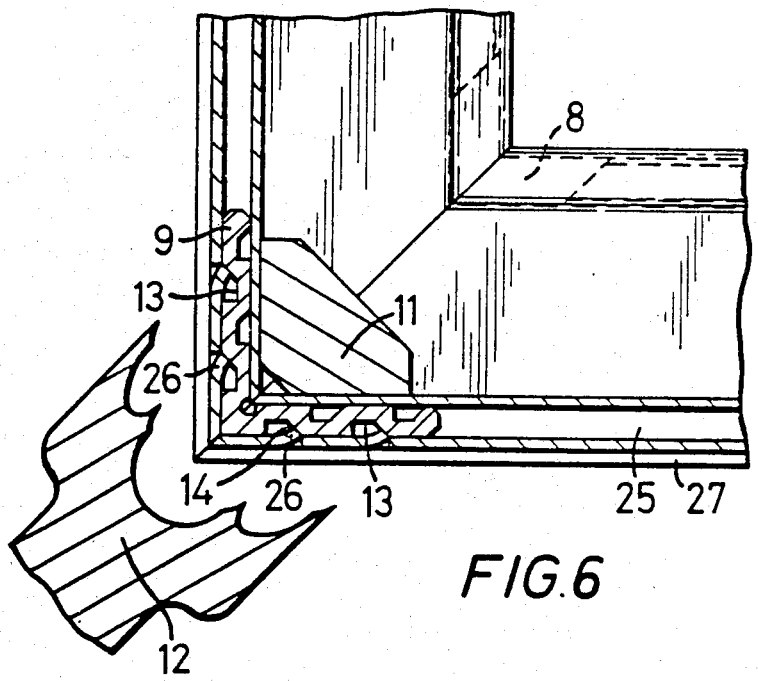
Figure 7:
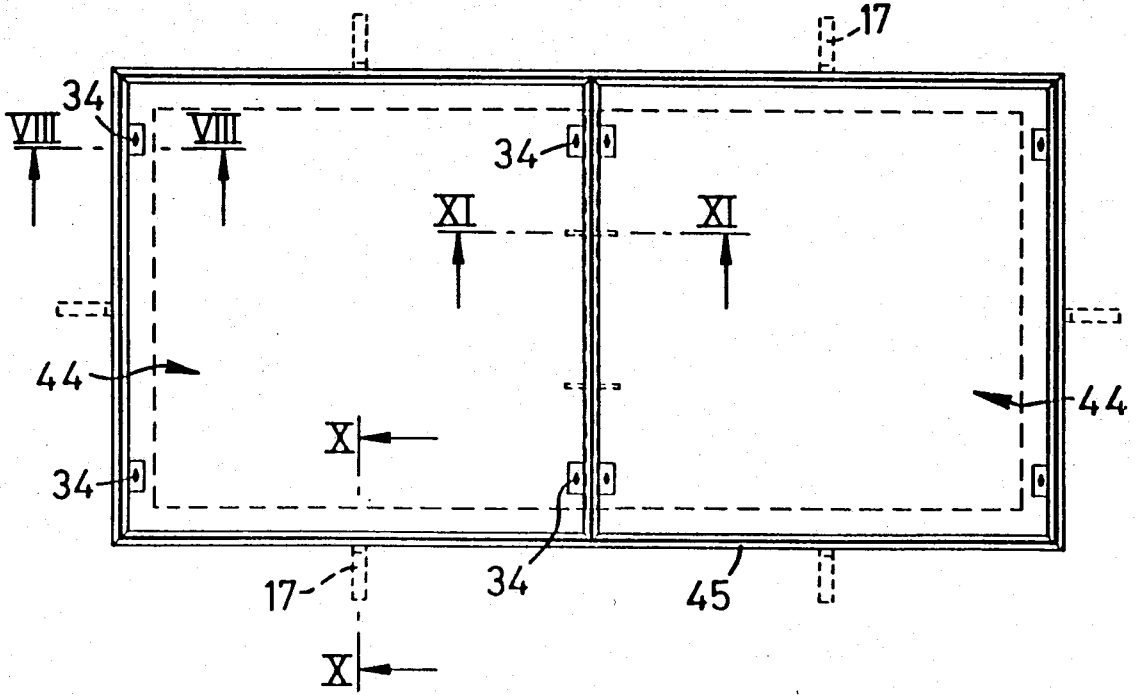
Figure 8:
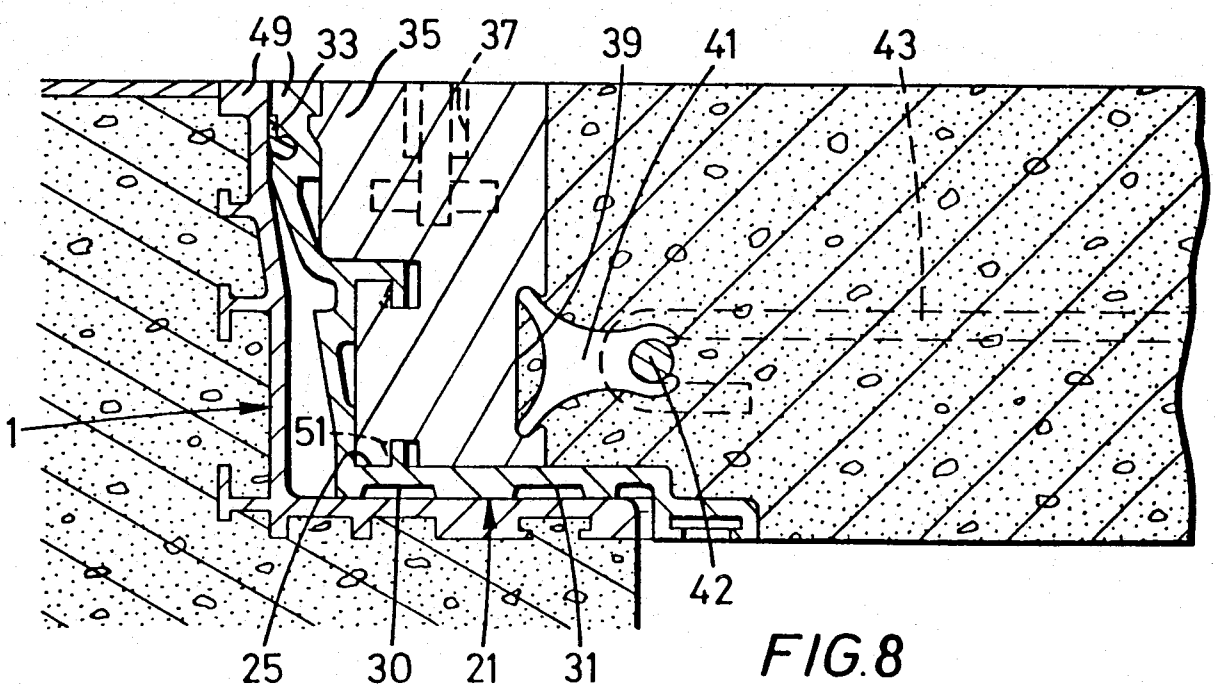
Figure 9:
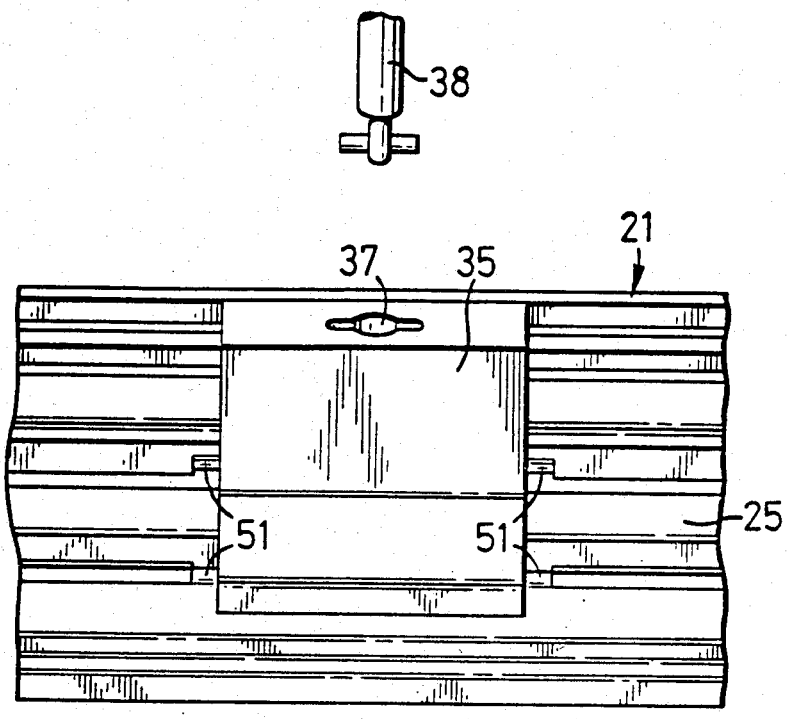
Figure 10:
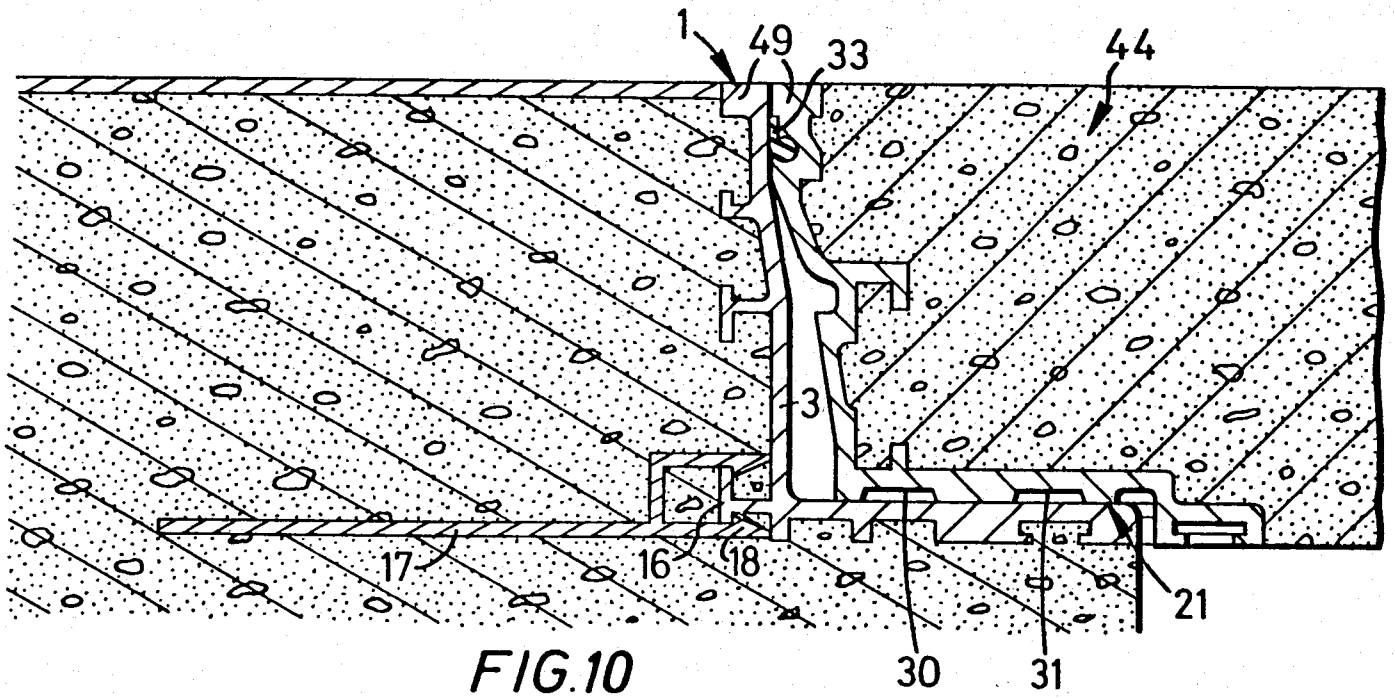
Figure 11:
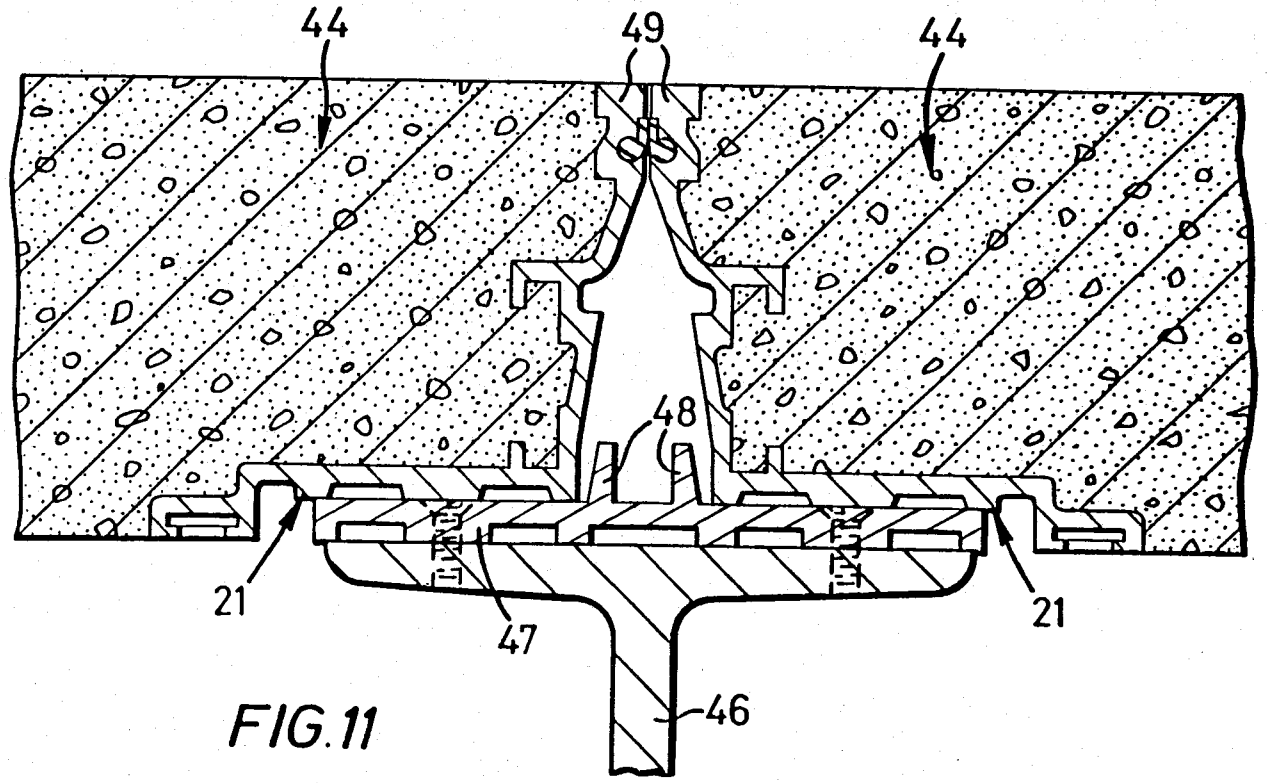

FIG. 3 is a section on the line III—III of FIG. 2 and shows schematically the manner in which the outer frame is crimped at a corner, FIG. 4 is an exploded perspective view showing the manner of assembly of the inner frame at a corner, FIG. 5 shows a side elevation of an assembled corner of the inner frame, FIG. 6 is a section on the line VI—VI of FIG. 5 and shows schematically the manner in which the inner frame is crimped at a corner, FIG. 7 is a plan view of a manhole access in which two cover members are mounted in a common outer frame, FIG. 8 is a section on the line VIII—VIII of FIG. 7, FIG. 9 is a fragmentary side view of the inner surface of the inner frame showing the mounting of a lifting block, FIG. 10 is a section on the line X—X of FIG. 7, and FIG. 11 is a section on the line XI—XI of FIG. 7.

Referring now more particularly to FIGS. 1 to 3 of the drawings, the manhole access cover has an outer rectangular frame formed from four lengths of angle member 1 formed as aluminium extrusions and joined to each other at the corners of the rectangle. Each angle member has a limb 2 which in use of the outer frame extends substantially horizontally and a limb 3 which in use extends substantially vertically; thus the finished frame has a continuous substantially vertical wall and a continuous substantially horizontal ledge extending inwardly from the vertical wall. On the outer surfaces of the limbs 2 and 3 are provided a series of ribs which define between them a series of grooves or slots. Some of the ribs are formed with flanges at their free ends which flanges overlie the adjacent grooves to provide, so to speak, captive grooves. Thus as shown in FIG. 1 the grooves 4, 5, 6 and 7 are captive grooves. The grooves 4 are provided in the lower part of the vertical wall.

Prior to joining two angle memebrs 1 together at a corner their ends are first mitred. The two angle members 1 are then brought together as indicated by the arrows in FIG. 1 and at the same time an angular corner plate 8 and an angular corner member 9 are located so that they slide into the grooves 4 and 5 respectively of the two angle members 1. Thus the corner members 9 extend widthwise only part way up the vertical wall substantially from the lower edge thereof. After assembly of the outer frame in this way, it is placed in a crimping machine in which as shown in FIG. 3 an anvil 11 locates in each corner of the frame and a crimping tool 12 is applied to the outside of the frame.

The corner members 9 have on both their inner and outer surfaces a series of vertical grooves 13, the grooves side walls 14 nearer the ends of the corner members 9 sloping as a ramp to the top of the groove as best seen in FIG. 3. When the crimping tool 12 is applied it pierces tongues 15 out of the flanges 16 and bends them into the grooves 13 in the corner member 9 to engage against the sloping groove side walls 14. Thus the further the tongues 15 are bent inwards the tighter is the jointing at the corners.

The grooves provided on the outer surfaces of the limbs 2 and 3 of angle members 1 enable a good keying of the outer frame with the surrounding concrete or mcrtar when the outer frame is fitted as shown in FIGS. 8 and 10. However, further keying can be provided by anchoring members 17 (FIG. 10) which have forked ends locating over the flanges 16 and provided with barbs 18 which are trapped behind the flanges 16.

Referring now more particularly to FIGS. 4 to 6, the inner frame of the manhole access cover has an inner rectangular frame which is closed by concrete or other appropriate filling to form a cover member and which in use fits closely within the outer frame. The inner frame is, similarly to the outer frame, formed from four lengths of angle member 21 which are produced as aluminium extrusions. Each length of angle member has a limb 22 which in use extends horizontally so that it forms a ledge which rests on the underlying ledge formed by the limbs 2 of the outer frame and a limb 23 which in use extends generally vertically so that it forms a vertical wall which lies adjacent the vertical wall of the outer frame As best seen in FIGS. 8 and 10, the limbs 23 extend vertically for a distance from their upper edge so that over this region they are a close fit in the outer frame and then slope inwardly away frcm the outer frame, to facilitate lifting of the inner frame out of the outer frame.

The angle members 21 are formed with ribs on both their inner and outer surfaces as best seen in FIG. 4 and which between they define grooves. Thus grooves 24 and 25 are provided which correspond in function to the captive grocves 4 and 5. In the case of the outer frame however, the groove 25 is formed on the inside of the angle member 21. The grooves 30 and 31 provide locations for sealing strips to provide a low pressure double gas seal with the outer frame.

Prior to joining the angle members 21 together at a corner their ends are a first mitred. The angle members 21 are then brought together and at the same time corner plates 8 and corner members 9 of the same form as those used for the cuter frame, are located so that they slide into the grooves 24 and 25.

The inner frame is so designed that after assembly it can be crimped in the same crimping machine as used for the outer frame and similarly crimped from the outside of the frame. However, in this crimping operation the crimping tool punches tongues 26 out of the walls of the limbs 23 of the angle members 21 into grooves 13 of the corner members 9.

To enable the same crimping machine to be used for the outer frame as for the inner frame, the outer surface of each of the limbs 23 is provided with a groove 27 and a vertically extending lower margin 28. The bottom of the groove 27 and the margin 28 are vertically aligned as shown by chain-dotted dotted line 29 in FIG. 5 and their spacing and other dimensioning in relation to common reference points on the angle members 2 and 21 being such that they correspond in position as seen by the crimping tool to the flanges 16 overlying the grooves 5 in the angle members 1 as can best be seen from a comparison of FIGS. 3 and 6.

The internal ribs on the angle members 21 provide good keys for the concrete or other material used to fill the inner frame as seen in FIGS. 10 and 11.

In the vertically extending region at the upper edges of the vertical limbs 23 of the angle members 21 a groove is provided for receiving a sealing member 33 which seals against the outer frame as best seen in FIGS. 8 and 10.

In order to provide lifting points for the cover member as shown at 34 in FIG. 7 lifting blocks 35 (FIGS. 8 and 9) are located in the grooves 25 of the angle members 21. These are slid into place along the grooves 25 prior to joining the angle members 21 together at their corners. The lifting blocks 35 are slid sufficiently far along the grooves 25 that they do not interfere with the fitting of the corner members 9. The lifting blocks are provided with slot formations 37 for receiving lifting keys shown at 38 in FIG. 9. The lifting blocks are located by crimped in tongues 51. The lifting blocks 35 also in this example provide locations for metal reinforcement of the cover members. Advantageous-ly all the elements of the inner and outer frames so far described can be fabricated from aluminium. The reinforce-ment is preferably of iron and to prevent electrolytic action arising from contact between aluminium and iron the lifting blocks are provided with undercut slots 39 (FIG. 8) in which plastics clips 41 are a snap fit. The clips 41 receive in a snap fit iron rods 42. Thus the four lifting blocks locate between them two parallel rods 42. Further rods 43 can span the two rods 42 and hook over them as shown in FIG. 8. Alternatively a reinforcing grid or mesh can be supported by the two rods 42.

In use a single or a plurality of cover members may be supported by a single outer frame. Two cover members 44 are shown supported by a single outer frame 45 in FIG. 7. However a long row of cover members 44 may be supported by a single elongated outer frame 45. Alternatively four or more cover members 44 may be supported in two rows by a single outer frame 45. Particularly in the latter case it may be desirable to provide a spacer member for the cover members extending across the middle of the outer frame. One such spacer member is shown in FIG. 11 and comprises a beam 46 which locates at its ends in opposite sides of the outer frame 8 and a platform 47 which locates on the beam 46 and is attached to it. The platform supports the adjacent sides of the two inner frames 21 as shown and has two up-standing ribs 48 against which the inner frames can abut to limit sideways movement of the cover members 44 relatively to the outer frame.

Since the outer frames are advantageously made of aluminium in contrast to galvanised iron they can be ground without detriment in order to correct for any misalignment with the surrounding floor level. Hence the top lips 49 on the outer and inner frames can be made thick enough to allow for such grinding with cut affecting the strength of the outer frame.

I claim:

1. An access cover comprising an outer frame and a removable cover member which fits within said outer frame, the cover member comprising an inner frame with an appropriate filling, each said frame being shaped in plan to provide corners and being fabricated from a plurality of lengths of angle-section frame members, each comprising interconnected wall and ledge portions, mitred at their ends to facilitate being joined to each other by joints at said corners to define a substantially vertical wall, formed from said wall portions, and a substantially horizontal ledge, formed from said ledge portions, extending inwardly from the vertical wall, the joint at each corner including an angular corner member with limbs to which the frame members are connected, wherein said lengths of frame members are metal extrusions each formed with a longitudinally extending captive groove in its wall portion, each said angular corner member being shaped so that its limbs fit around the corner within said captive grooves of the associated wall portions, said captive grooves being coaligned, said corner members each defining at least one vertical groove in each of its limbs with a respective wall of each said vertical groove being angled to provide opposed sloping receiving faces in one limb relative to the other limb and, for each corner, the respective frame members being joined together by simultaneously piercing tongues from their wall portions and crimping said tongues directly into positive engagement against the slope of the receiving faces of the corner member to urge the frame members together at the corner concerned.

2. An access cover according to claim 1, wherein the ledge portions each define a further longitudinally extending captive groove, adjacent the free edge of the ledge portion on the underside of the ledge and wherein an additional angular corner plate is shaped to locate at each corner of the frame in said further captive groove so that it extends across the joint of said corner formed by the mitred ends of the frame members.

3. An access cover according to claim 1, wherein the captive gooves in the vertical wall of the outer frame are located on the external faces of the outer frame, and the captive grooves of the vertical wall of the inner frame are located on the inner faces for the inner frame, and wherein the dimensioning of the frame members and all said captive grooves is such that the same corner members can be used for both the outer and inner frames, and the same tool can be used to pierce and crimp both the inner and outer frames, piercing of the inner frame members causing tongues to be formed out of the respective wall portions of the inner frame and piercing of the outer frame members causing tongues to be formed out of retaining flanges of the captive grooves of respective wall portions of the outer frame.

4. An access cover according to claim 1, wherein the vertical wall of the inner frame fits closely within the vertical wall of the outer frame in the region of its upper edge and then diverges away from it to form a space therebetween, a sealing member is located around the inner frame adjacent its upper edge for sealing with the outer frame to prevent ingress of dirt, wherein the underside of the horizontal ledge of the inner frame is provided with grooves which may receive sealing strips for gas and liquid sealing with the horizontal ledge of the outer frame if required.

* * * * *